US005630646A

United States Patent [19]

Trimble

[11] Patent Number: 5,630,646

[45] Date of Patent: May 20, 1997

[54] SWIVEL GLIDER CHAIR ASSEMBLY

[76] Inventor: David W. Trimble, P.O. Box 161, Rose Creek, Minn. 55970

[21] Appl. No.: 395,566

[22] Filed: Feb. 28, 1995

[51] Int. Cl.[6] ..... A47D 13/10

[52] U.S. Cl. ..... 297/281; 297/282; 297/273; 297/344.26; 297/344.12

[58] Field of Search ..... 297/282, 281, 297/273, 344.21, 344.26, 344.12; 248/188.7, 415, 431

[56] References Cited

U.S. PATENT DOCUMENTS

| | | | |
|---|---|---|---|
| 561,719 | 6/1896 | Menuez | 297/344.26 X |
| 2,916,084 | 12/1959 | Bottemiller et al. | 297/344.26 X |
| 3,142,471 | 7/1964 | Silver | 297/344.21 X |
| 3,829,157 | 8/1974 | Lange, Jr. | 297/344.26 X |
| 4,440,372 | 4/1984 | Wisniewski | 297/344.21 |
| 4,971,394 | 11/1990 | Vanderminden | 297/344.21 X |
| 5,024,483 | 6/1991 | Kamman | 297/281 X |
| 5,039,164 | 8/1991 | Gibbs | 297/344.21 X |
| 5,344,214 | 9/1994 | Trent | 297/273 X |

*Primary Examiner*—Peter R. Brown
*Assistant Examiner*—Stephen Vu
*Attorney, Agent, or Firm*—Merchant, Gould, Smith, Edell, Welter & Schmidt, P.A.

[57] ABSTRACT

An improved swivel glider chair and support base structure therefor are disclosed. The support base includes channeled leg retaining block members that cooperatively sandwich and retainably grip a plurality of support legs in radially extending manner about a base axis. Base height adjustment is provided by a plurality of spacer blocks that can be selectively incorporated when constructing the base to vary the height of the seat portion of the chair to accommodate the chair user. A full race ball bearing swivel assembly provides increased stability to the assembly.

9 Claims, 4 Drawing Sheets

SWIVEL GLIDER CHAIR ASSEMBLY

FIELD OF THE INVENTION

This invention relates generally to chair construction, and more particularly to a swivel gliding chair having an improved adjustable base configuration.

BACKGROUND OF THE INVENTION

Swing rocker or "glider" chairs and swivel chairs have long been known in the art. The basic principles of a glider chair are illustrated in the early U.S. Pat. No. 383,808 to Hall, and in the more recent U.S. Pat. No. 5,024,483 to Kamman. A stable technique for supporting the movable seat or chair proper portion of such configurations has been to pivotally hang or suspend the chair proper portion from and between a pair of stationary base or standard members, as for example illustrated in the Hall patent. Since the chair proper portion of such structures lies between the spaced support standards, this type of configuration is very stable as the chair proper pivotally glides between the supports. Such configurations, however, do not permit the chair proper portion of the assembly to "swivel" relative to the base supports.

The desirability of combining a swivel feature with the swinging or gliding chair motion was recognized early on by the structures described in U.S. Pat. No. 561,719 to Menuez. Menuez replaced the spaced support standards of Hall with a central base support having a plurality of legs radially extending from a vertically oriented central hub or spindle member to which was attached a revolving platform or bed configured to rotate in a horizontal plane about the spindle axis. The revolving platform, in turn, operatively supported the chair proper for transverse gliding motion relative to the central base through a stirrup and hanger assembly, well-known in the art. While the Menuez structure provides a configuration for combining swivel and gliding motion in a chair, the support structure required is heavy and generally unattractive, is typically configured of steel or other heavy metal portions requiring maintenance, and does not provide for ready vertical height adjustment of the support platform.

More recent swivel glider chair base configurations have been developed over the years as illustrated by the structure shown in the more recent U.S. Pat. No. 4,700,920 to Horn. However, such structure is fairly complex and also does not provide for manufacturing flexibility in adjusting the height of the chair proper portion of the assembly.

The present invention addresses the above-described shortcomings of the prior art by providing a simple, easy to manufacture and aesthetically pleasing base configuration for swivel gliding chairs. The base support of this invention enables the seat portion of the chair to be adjusted in height to accommodate the chair's primary user, in a stable manner. The base support design is readily applicable to straightforward, relatively inexpensive manufacturing processes.

SUMMARY

A base configuration is provided for a swivel gliding chair that stably distributes the weight from the chair proper to a plurality of radially extending floor-engaging legs. The unique central portion of the base enables the chair to stably support significantly more weight than prior known swivel glider chairs. While the base provides for adjustment of the chair's seat height, the overall center of gravity of the chair remains low enough to provide a safe and stable operating environment for the chair.

According to one aspect of the invention there is provided a swivel glider chair assembly comprising:

(a) a chair proper;

(a) a base disposed about a base axis, comprising:

(i) a plurality of floor-engaging legs;

(ii) leg retaining means comprising a pair of opposing retainer members, for retainably sandwiching a portion of each of said legs therebetween and for radially aligning said legs about said axis;

(iii) an upper base support member;

(iv) variable spacer means disposed between said upper base support member and said leg retaining means for selectably varying the spacing therebetween; and (v) means for fixedly securing said leg retaining means, said variable spacer means and said upper base support to one another;

(c) swivel means having a pair of generally parallel spaced mounting plates, said plates being rotatably movable in parallel planes relative to one another;

(d) means for fixedly mounting a first of said pair of swivel mounting plates to said upper base support such that said second of said swivel mounting plates rotatably moves about said axis; and glider means operatively mounted to a second of (e) said pair of swivel mounting plates and to said chair proper for imparting transverse gliding motion to said chair proper relative to said second swivel mounting plate.

The variable spacer means can comprise a plurality of disk members coaxially aligned with the base axis and the swivel means may preferably include a full circular race of ball bearings.

According to yet another aspect of the invention, there is provided a base configuration for a swivel chair, comprising:

(a) a plurality of leg members;

(b) a first leg retaining member having a plurality of channels formed therein extending into said first leg retaining member from one surface thereof and outwardly from an axis;

(c) a second leg retainer member having a plurality of channels formed therein extending into said second leg retaining member from one surface thereof and outwardly from an axis;

(d) wherein respective ones of said channels of said first and said second leg retaining members operatively align with one another when said first and said second leg retaining members are coaxially aligned, said channels being sized to cooperatively accept and retainably hold one end of said plurality of leg members;

(e) means for fixedly securing said first and said second leg retaining members to one another in sandwiching manner about said one ends of said plurality of leg members;

(f) means for fixedly securing said first and said second retaining members together for securing said plurality of leg members thereto;

(g) pedestal means operatively connected to said first leg retaining means and coaxially aligned therewith, said pedestal means defining an upper surface vertically spaced from said first leg retaining member; and (h) a swivel means having one mounting plate fixedly secured to said upper surface of said pedestal means, for providing relative rotational movement of a second mounting surface of said swivel about said axis and in a plane orthogonal thereto.

These and other features of the invention will become more apparent upon a more detailed description of a preferred embodiment of the invention.

BRIEF DESCRIPTION OF THE DRAWINGS

Referring to the Drawing, wherein like numerals represent like parts throughout the several views.

DETAILED DESCRIPTION OF THE INVENTION

Figure 1:
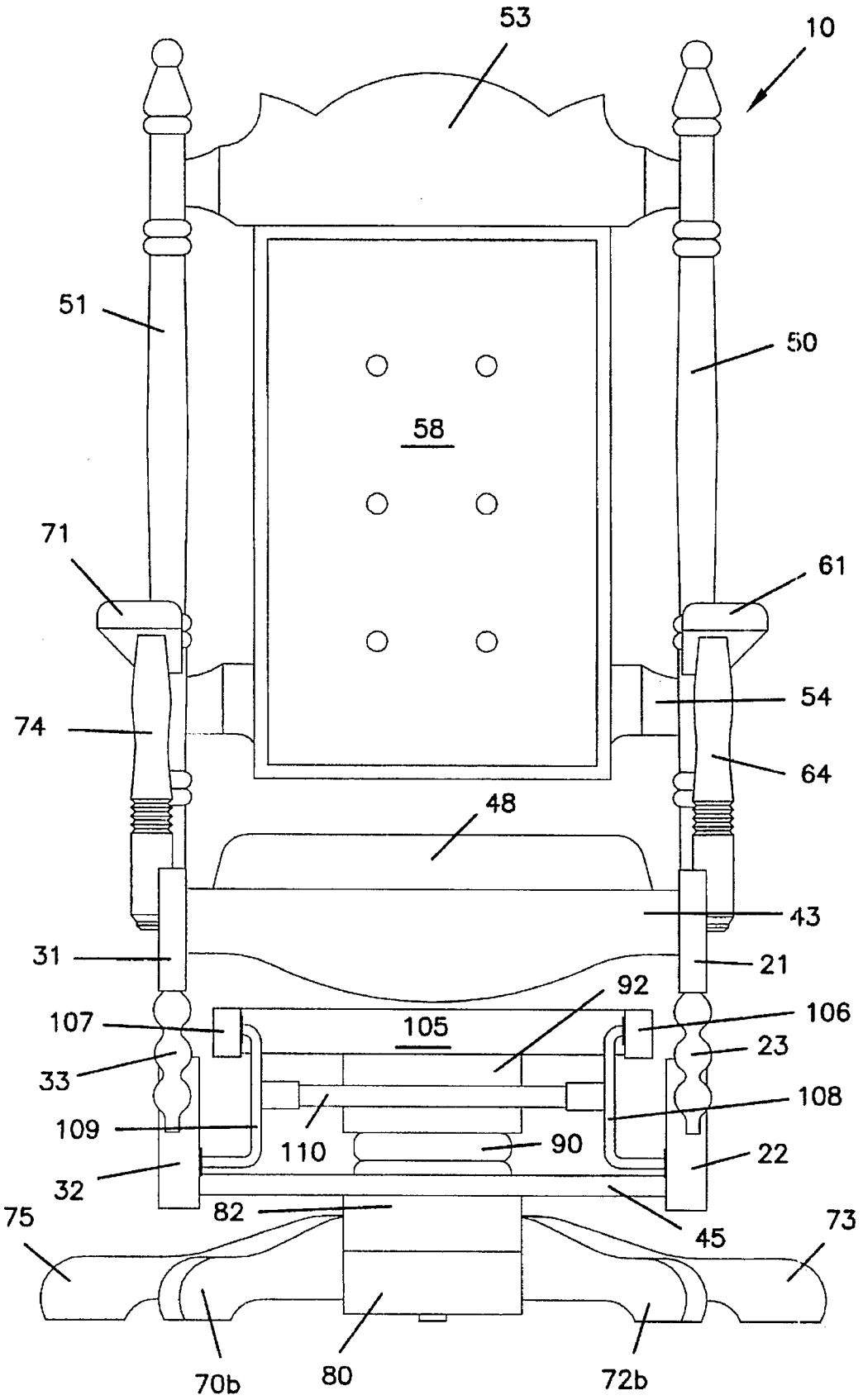
FIG. 1 front plan view of a preferred embodiment of a swivel gliding chair incorporating the principles of this invention.

Referring to the Drawing, a preferred embodiment of a swivel glider chair constructed according to the principles of this invention is generally illustrated at 10 in FIG. 1. As illustrated in more detail in FIG. 2, the chair 10 has an upper chair proper portion 10*a* (illustrated in partially exploded manner) which is carried and supported by a lower base assembly, generally indicated at 10*b*. It will be understood that while a particular style and configuration of the swivel glider chair 10 will be illustrated and used to describe the principles of the invention, that the invention is not limited to the particulars of the style of chair illustrated. Those skilled in the art will readily recognize multiple variations of such chair designs and configurations that can be employed within the spirit and intent of this invention.

In the preferred embodiment, the chair 10 is preferably constructed from hardwood materials such as oak, cherry, walnut or the like, and comprises an aesthetically pleasing piece of fine furniture. The upper chair proper 10*a* portion is best illustrated with reference to FIGS. 1 and 2. Referring thereto, the support structure for the chair proper is defined at its lower end by right and left 20 and 30 respectively. The right side rail assembly 20 includes an upper side rail 21 and a lower side rail 22 interconnected by means of a pair of front lower spindles 23 and 24, a rear lower spindle 25 and a plurality of seat spindles generally indicated at 26. A right seat tack strip 27 is secured along its longitudinal length to the inner surface of the upper side rail 21. The lower side rail 22 has a pair of bores 28 and 29 respectively formed near the front and rear portions of the lower side rail 22 through the inner surface thereof for cooperatively retainably holding cylindrical sleeve or bearing members (not illustrated) for operatively accepting the glider bracket members to be hereinafter described in more detail.

Similarly, the left side rail assembly 30 includes an upper side rail 31 and a lower side rail 32 interconnected by means of a pair of front lower spindles 33 and 34, a rear lower spindle 35 and a plurality of seat spindles generally indicated at 36. A left seat tack strip 37 is secured along its longitudinal length to the inner surface of the upper side rail 31. The lower side rail 32 has a pair of bores 38 and 39 respectively formed near the front and rear portions of the lower side rail 32 through the inner surface thereof for cooperatively retainably holding cylindrical sleeve or bearing members (not illustrated) for operatively accepting the glider bracket members to be hereinafter described in more detail.

The right and left side rail assemblies 20 and 30 are respectively secured to one another by appropriate mortise and tenon and/or dowel and glue techniques well-known in the art by means of a rear seat spindle 42, a front seat rail 43, respectively connecting the upper side rails 21 and 31, and by means of a pair of dowels 45 and 46 respectively interconnecting the front and rear portions of the lower side rails 22 and 32. A front seat tack strip 44 is secured along its longitudinal length to the inside surface of the front seat rail, and generally flush with its upper surface. The tack strips 27, 37 and 44, in combination with the rear seat spindle 42 provide a support structure for a fabric or cushion type of seat (generally illustrated at 48 in FIG. 1), in a manner well-known in the art. It will be appreciated that alternatively, the tack strips and rear seat spindle could be replaced by a continuous wooden seat.

Figure 2:
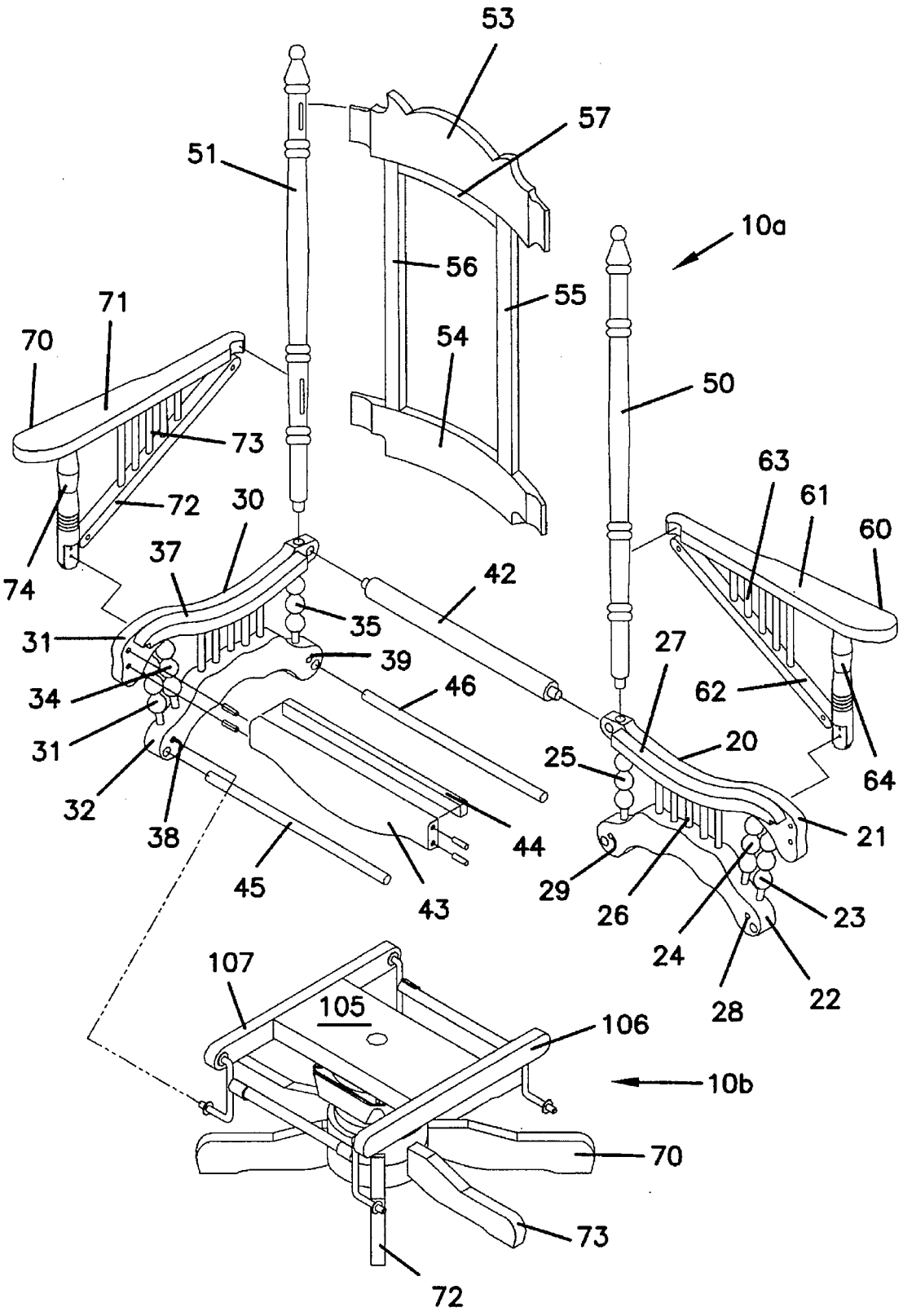
FIG. 2 partially exploded perspective view of the chair assembly of FIG. 1, illustrating the base assembly portion thereof separated from the upper chair portion.

A pair of right and left back spindles 50 and 51 respectively are secured in upright manner generally perpendicular to the upper back surfaces of the right and left upper side rails 21 and 31 respectively. The right and left back spindles 50 and 51 are secured together at their upper portions, in mortise and tenon fashion by means of a top back rail 53, and at their lower portions by means of a lower back rail 54. A pair of back tack strips 55 and 56 vertically extend between and interconnect the top and lower back rails 53 and 54, and an upper tack strip 57 is secured between the tack strips 55 and 56 and to the top back rail 53 along the lower surface thereof, as illustrated in FIG. 2. The tack strips 55, 56 and 57 provide the support structure for a fabric based back support portion of the chair (generally illustrated at 58 in FIG. 1). As will be appreciated by those skilled in the art, the tack strips 55, 56 and 57 could be replaced by alternative back support structures such as by wooden spindles, slats, or the like.

Right and left arm assemblies 60 and 70 respectively are operatively connected between the right and left side rail assemblies 20 and 30 and the right and left back spindles 50 and 51 and the lower back rail 54. The right arm assembly 60 includes an upper arm 61 and a lower arm brace 62 interconnected by means of a plurality of arm spindles generally designated at 63. The rear portions of the upper arm 61 and the lower arm brace 62 are connected to the right back spindle 50. A arm rest spindle 64 is connected by a dowel configuration to and extends downwardly from the lower surface of the arm 61. The lower end of the arm rest spindle 64 and the lower arm brace 62 are respectively secured to the outer surface of the upper side rail 21. Similarly, the left arm assembly 70 includes an upper arm 71 a lower arm brace 72, a plurality of arm spindles 73 and an arm rest spindle 74 interconnected in identical manner to that previously described with respect to the right arm assembly, and secured to the left back spindle 51 and the left upper side rail 31 in reciprocal manner as previously described with respect to the right arm assembly.

Figure 3:
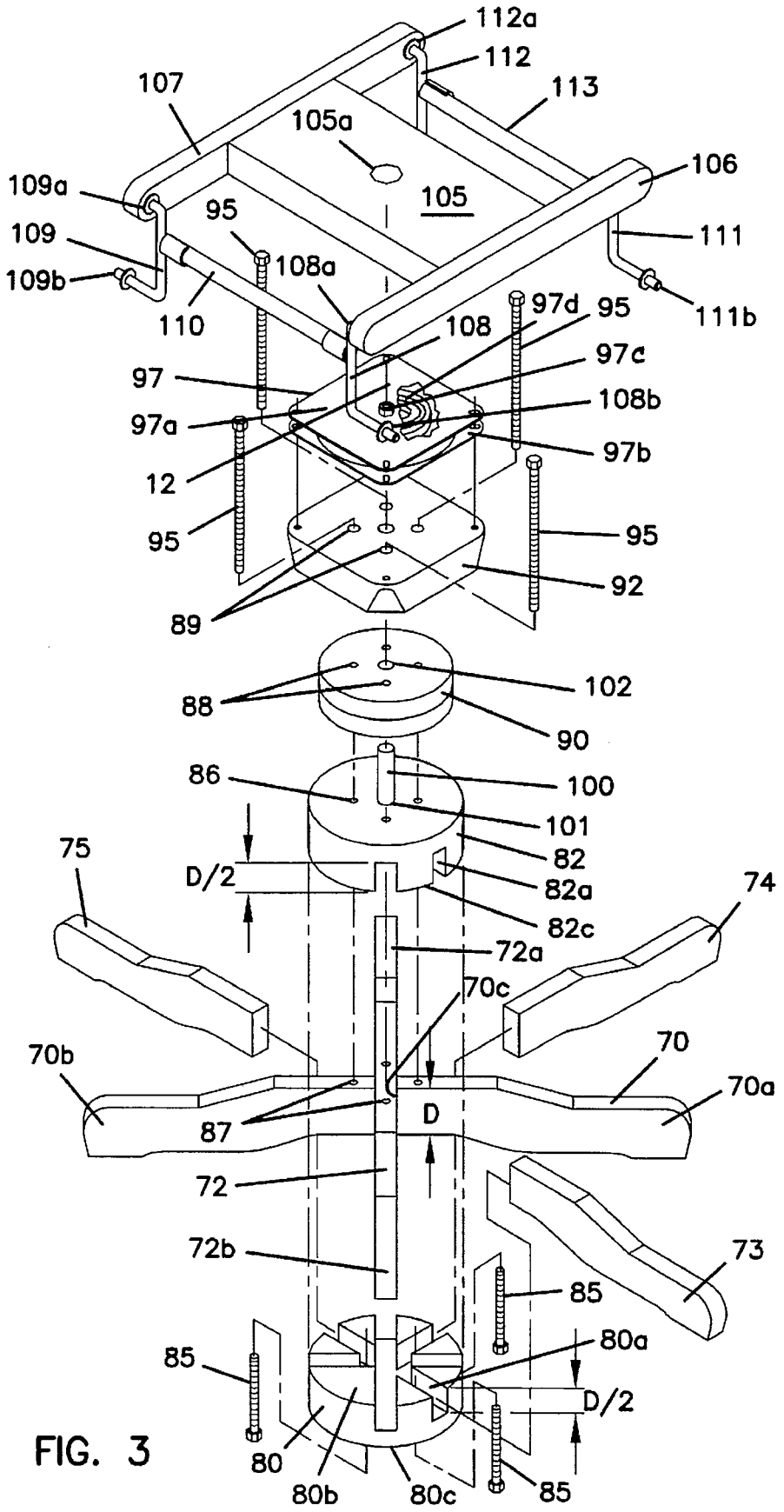
FIG. 3 is an exploded perspective view with portions thereof broken away, of the base assembly portion of the chair structure of FIGS. 1 and 2.

The upper chair proper 10*a* portion of the chair assembly is movably supported on the lower base assembly 10*b* by means of the bores 28, 29, 38 and 39 in the side rail assemblies 20 and 30, as hereinafter described in more detail. An exploded view of the lower base assembly 10*b* is illustrated in FIG. 3. Referring thereto the lower base assembly 10*b* is generally symmetrically disposed about a vertical axis 12. The lower base assembly is supported upon a floor surface by a plurality of leg members extending radially outward from the base assembly axis 12. The leg assembly includes a full length lower leg member 70 defining oppositely disposed first and second leg segments 70*a* and 70*b* respectively. The lower leg member 70 has a notch 70*c* extending down from its upper surface at its center. An upper full length leg member 72 having a notch extending from its lower surface at its center and sized to cooperatively mate with the notched 70*c* of the full length lower leg member 70, extends between oppositely disposed third and fourth leg segments 72*a* and 72*b* respectively. When the central notches of the lower and upper full length members 70 and 72 are cooperatively engaged with one another, the lower and upper leg members 70 and 72 are cooperatively engaged at right angles to one another in mating fashion such that their upper and lower surfaces are respectively planar along the axis 12, as illustrated in FIG. 3. In the preferred embodiment configuration of the lower base assembly 10*b*, three additional leg segments 73, 74 and 75 are provided and respectively define fifth, sixth and seventh floor-engaging leg segments respectively of the base assembly. The lengths of the leg segments 73–75 are, in the preferred embodiment, configured such that when their radially inner surfaces are butted up into engagement with the crossing lower and upper full length leg members 70 and 72, and are disposed at a generally 45 degree angle relative thereto (as indicated in FIG. 3), the radially outermost edges of the seven leg segments generally lie on a circle having the base assembly axis 12 as its center. The total symmetry of the leg configuration (as viewed from above), is broken in the preferred embodiment by not providing an eighth leg segment between the second 70*b* and fourth 72*b* leg segments of the assembly. In the preferred embodiment, the space between the second and fourth leg segments 70*b* and 72*b* respectively addresses the front portion of the chair assembly, and provides additional space for the feet of a person sitting on the chair, which also facilitates the ability of the person using the chair to stand up and sit down in the chair without having his/her feet interfere with the leg segments of the lower base assembly.

The legs 70, 72, 73, 74 and 75 are retainably fixed in their angular positions relative to one another, with the angular interleg segment spacing being 45 degrees between all leg segments except between the second and fourth leg segments 70*b* and 72*b*, which is at 90 degrees, by a pair of leg retainer disk blocks 80 and 82 respectively. The lower and upper leg retainer disk blocks 80 and 82 respectively are mirror image structures of one another, having radially extending slots 80*a* and 82*a* respectively defined therein and extending downwardly from one surface thereof at the angles above described so as to cooperatively engage and hold the seven leg segments therebetween. The depths of the leg retainer disk block slots 80*a* and 82*a* are respectively one-half of the central height dimension (generally designated at "D" in FIG. 3) of that portion of the leg segments disposed adjacent the base assembly axis 12. A top plan view of the lower leg retainer disk block 80 is illustrated in more detail in FIG. 4. The upper and lower surfaces of the lower leg retainer disk block 80 are generally indicated at 80*b* and 80*c* respectively. Similarly, the upper and lower surfaces of the lower leg retainer disk block 82 are respectively denoted at 82*b* and 82*c*. As indicated in FIG. 3, the grooves or channels 80*a* of the lower leg retainer disk block 80 extend from the upper surface 80*b* of the disk block; whereas the grooves or channels 82*a* of the upper leg retainer disk block 82 extend from the lower surface 82*c* of the disk block 82. When the lower and upper leg retainer disk blocks 80 and 82 respectively cooperatively matingly engage the seven leg segments of the lower base assembly, such that the upper surface 80*b* of the lower retainer disk 80 and the lower surface 82*c* of the upper retainer disk 82 cooperatively engage one another, the respective channels 80*a* and 82*a* of the lower and upper retainer disk blocks 80 and 82 retainably engage and hold the leg segments at the predetermined angles determined by the channels 80*a* and 82*a* of the retainer disk blocks.

Figure 4:
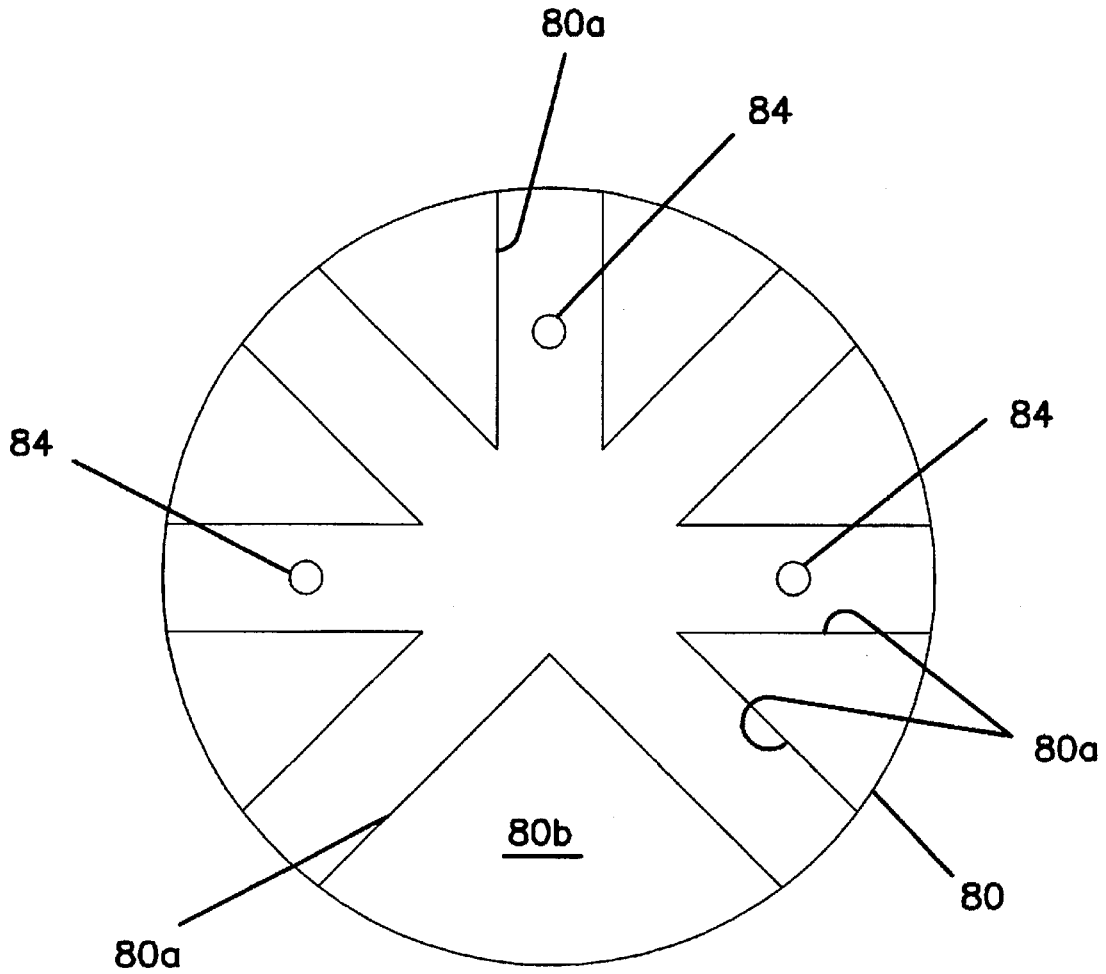
FIG. 4 is an enlarged top plan view of the lower leg retainer disk block portion of the base assembly structure of FIGS. 2 and 3.

The lower leg retainer disk block 80 includes three holes or bores 84 formed therethrough aligned with those channels 80*a* that cooperatively engage the fifth, sixth and seventh leg segments 73, 74 and 75 respectively, as best illustrated in FIG. 4. Three lag bolts, generally indicated at 85 (FIG. 3), are threaded through the bores 84 and into the associated fifth through seventh leg segments 73, 74 and 75 associated with such grooves, to retainably prevent the fifth through seventh leg segments 73, 74 and 75 from radially moving out of retaining engagement with the disk blocks 80 and 82. The full length lower and upper leg members 70 and 72 do not require additional lag bolt fastening from below as provided for the fifth through seventh leg segments 73, 74 and 75, since the interlocking relationship between the full length legs 70 and 72 prevent such members from separating from one another. The sandwiching clamping forces provided by the disk blocks 80 and 82 on the leg members 70 and 72 firmly retain such leg members in a fixed position relative to the base assembly axis 12.

The upper leg retainer disk block 82 includes an axial bore 101 sized to slidably accept an alignment dowel, generally indicated at 100. The upper leg retainer disk block 80 further has four radially spaced bores, generally indicated at 86 arranged to cooperatively align with four bolt starter holes in the top surfaces of the full length lower leg members 70 and 72, and generally indicated at 87. One or more spacer block disks 90 are sized to cooperatively overlie and coaxially align with the upper leg retainer disk block 80. The spacer block disks include an axial bore, generally indicated at 102 which aligns with bore 101 and is sized to cooperatively accept the alignment dowel 100, for coaxially aligning the spacer block disks 90 with the upper leg retainer disk block 80 during the assembly process of the lower base assembly 10*b*. The spacer block disks 90 further have four bores 88 formed therethrough and in vertical alignment respectively with the bores 86 and starter holes 88 in the upper leg retainer disk block 82 and the full length leg members 70 and 72 respectively. In the preferred embodiment, the spacer blocks are between six and seven inches in diameter and are approximately one inch thick. The number of such spacer blocks used in constructing a lower base assembly can be selected to correspond to the height of the chair user. The number of spacer blocks used for accommodating a user of average height is typically from three to five; whereas the number that might be required for a tall user might be as many as seven spacer blocks.

A generally rectangular upper base support member 92 is designed for coaxial placement upon the spacer blocks 90 as illustrated in FIG. 3. As with the upper leg retainer disk block 82 and the spacer block disks 90, the upper base support 92 includes an axial bore of the same dimensions as bores 101 and 102 for receiving the alignment dowel 100, and four bores 89 cooperatively aligned with the bores 86 and 88 and with the starter holes 87. The upper portions of the bores 89 are countersunk to accept the head portion of lag bolts, as hereinafter described. The bores 86, 88 and 89, when operatively aligned, cooperatively accept the shanks of four leg bolts 95 therethrough. The lag bolts 95 are sized in cooperation with the number of spacer blocks 90 that are used such that when inserted through the aligned bores 86, 88 and 89 and when screwed into the lag members 70 and 72 through the starter holes 87 formed therein, extend approximately one-half of the distance (i.e., D/2) into the leg members. When so secured, the lower leg assembly comprising the upper base support 92, the spacer blocks 90, the upper and lower retainer disk blocks 82 and 80 and the leg portions form an integral solid base structure.

A swivel bearing structure 97, containing a full race of ball bearings and spring biased to return to a neutral position, as illustrated in FIG. 3, as is well-known in the art is configured for mounting to the upper base support block 92 as illustrated in FIG. 3. Preferably, the outer dimensions of the upper base support block 92 are cooperatively sized slightly larger than the outer dimensions of the swivel bearing 97. The swivel bearing 97 has upper and lower mounting plates 97*a* and 97*b* respectively pivotally secured for rotational movement in horizontal planes relative to one another and about the base assembly axis 12, by means of an axially aligned bolt 97*c*. The lower mounting plate 97*b* of the swivel bearing assembly 97 is secured by appropriate screws or lag bolts (not illustrated) through holes at its corners to the underlying upper base support block 92. Similarly, the upper mounting plate 97*a* of the swivel bearing assembly 97 is secured by mounting screws or lag bolts (not illustrated) through holes at its corners to the bottom of the primary base support, to be hereinafter described. A torsion spring member, generally illustrated at 97*d* interconnects the upper and lower mounting plates and provides spring bias force for rotating the plates relative to one another about the axis 12 whenever the plates are rotated relative to one another away from the "neutral" position illustrated in FIG. 3. The rotational force provided by the spring tends to return the plates to their neutral position, in manner well-known in the art. Such swivel bearing structures can be commercially purchased in the marketplace.

A generally rectangular primary base support 105 has a hole or bore 105*a* formed therethrough and configured for coaxial alignment with the base assembly axis 12. Right and left rail members 106 and 107 respectively are secured to opposing longitudinal ends of the primary base support 105. When secured to the lower base assembly apparatus previously described by means of the upper mounting plate 97*a* of the swivel bearing 97, the head or nut portion of the swivel bearing bolt 97*c* extends into the bore 105*a* of the primary base support member. Similarly, the opposite (lower) end of the bolt 97*c* extends downwardly into the bore 102 of the uppermost spacer block disk 90 such that the upper and lower mounting plates 97*a* and 97*b* of the swivel bearing 97 rest in secure flat engagement respectively with the bottom surface of the primary base support 105 and the upper surface of the uppermost spacer block 90.

The forward (as viewed in FIG. 3) ends of the right and left rails 106 and 107 have bores extending through their inwardly directed surfaces which are sized to cooperatively rotatably accept a front pair of U-shaped glider bracket members, generally indicated at 108 and 109. The glider brackets 108 and 109 have a first end 108*a* and 109*a* configured for rotatable engagement within the forward bores of the right and left side rail members 106 and 107 respectively, and second ends 108*b* and 109*b* respectively configured for cooperative rotatable insertion within the forward bores 28 and 38 of the lower side rails 22 and 32 respectively of the chair proper 10*a*. A front bracket support rod 110 horizontally extends between the front glider brackets 108 and 109 and retainably holds the brackets in operative position within their respective retaining bores. As previously stated, the bores within which the glider brackets 108 and 109 ride may contain sleeve or bearing members. The rear portions of the right and left side rails 106 and 107 similarly contain bores for cooperatively receiving a pair of rear glider brackets 111 and 112 respectively. The glider brackets 111 and 112 are generally of the same configuration as that previously described with respect to the front glider brackets 108 and 109, and have first ends 111*a* and 112*a* configured for operative rotational engagement with the right and left side rail members 106 and 107 respectively, and second ends 111*b* and 112*b* operatively configured for rotational insertion within the rear bores 29 and 39 respectively of the lower side rails 22 and 32. A rear bracket support 113 is horizontally mounted between the rear glider brackets 111 and 112 and maintains the brackets in operative position within their respective bores.

As can be appreciated, a number of variations can be made to the base assembly within the spirit and scope of this invention. The foregoing description of a preferred embodiment of the invention has been disclosed for purposes of discussion and describing the invention, and is not intended to be limiting in any manner other than by the appended claims. Accordingly, the invention is not limited to the described embodiment, or to the use of specific components, configurations or materials described therein. All alternative modifications and variations of the present invention which fall within the broad scope of the appended claims are covered.

What is claimed is:

1. The swivel glider chair assembly comprising:

(a) a chair proper;

(b) a base disposed about a base axis, comprising;

(i) a plurality of floor-engaging legs;

(ii) leg retaining means comprising a pair of opposing retainer members for retainably sandwiching a portion of each of said legs therebetween and for radially aligning said legs about said axis:

(iii) an upper base support member;

(iv) variable spacer means disposed between said upper base support member and said leg retaining means for selectably varying the spacing therebetween; and (v) bolts for operatively fixedly securing said leg retaining means, said variable spacer means and said upper base support to one another;

(c) swivel means having a pair of generally parallel spaced mounting plates, said plates being rotatably movable in parallel planes relative to one another;

(d) means for fixedly mounting a first of said pair of swivel mounting plates to said upper base support such that said second of said swivel mounting plates rotatably moves about said axis; and (e) glider means operatively mounted to a second of said pair of swivel mounting plates and to said chair proper for imparting transverse gliding motion to said chair proper relative to said second swivel mounting plate.

2. The swivel glider chair assembly comprising:

(a) a chair proper;

(b) a base disposed about a base axis, comprising;

(i) a plurality of floor-engaging legs;

(ii) leg retaining means comprising a pair Qf opposing retainer members, for retainably sandwiching a portion of each of said legs therebetween and for radially aligning said legs about said axis;

(iii) an upper base support member;

(iv) variable spacer means disposed between said upper base support member and said leg retaining means for selectably varying the spacing therebetween; and (v) means for fixedly securing said leg retaining means, said variable spacer means and said Upper base support to one another;

(c) swivel means having a pair of generally parallel spaced mounting plates a full circular race of ball bearings operatively mounted therebetween, said plates being rotatably movable in parallel planes relative to one another, and spring bias means for pivotally returning the relative rotational positions of said pair of swivel mounting plates to a neutral position;

(d) means for fixedly mounting a first of said pair of swivel mounting plates to said upper base support such that said second of said swivel mounting plates rotatably moves about said axis; and (e) glider means operatively mounted to a second of said pair of swivel mounting plates and to said chair proper for imparting transverse gliding motion to said chair proper relative to said second swivel mounting plate.

3. The swivel glider chair as recited in claim 1, wherein said base includes an odd number of said legs arranged in such manner that a larger radial angle exists between two of said legs than between the remaining legs.

4. The swivel glider chair as recited in claim 3, wherein said chair proper is mounted to said base in a manner such that a front of said chair proper is operatively aligned with the wider space between said two legs.

5. The base configuration for a swivel chair, comprising:

(a) a plurality of leg members;

(b) a first leg retaining member having a plurality of channels formed therein extending into said first leg retaining member from one surface thereof and outwardly from an axis;

(c) a second leg retainer member having a plurality of channels formed therein extending into said second leg retaining member from one surface thereof and outwardly from an axis;

(d) wherein respective ones of said channels of said first and said second leg retaining members operatively align with one another when said first and said second leg retaining members are coaxially aligned, said channels being sized to cooperatively accept and retainably hold one end of said plurality of leg members;

(e) means for fixedly securing said first and said second leg retaining members to one another in sandwiching manner about said one ends of said plurality of leg members and for securing said plurality of leg members thereto;

(f) pedestal means operatively connected to said first leg retaining means and coaxially aligned therewith, said pedestal means defining an upper surface vertically spaced from said first leg retaining member; and (g) a swivel means having a first mounting plate fixedly secured to said upper surface of said pedestal means, for providing relative rotational movement about said axis and in a plane orthogonal thereto of a second mounting plate of said swivel means; wherein said second mounting plate is axially spaced distally from said pedestal means and from said first mounting plate.

6. The base configuration as recited in claim 5, wherein said pedestal means includes means for selectively varying the height of said pedestal means so as to change the distance of said upper pedestal surface from said first leg retaining member.

7. The base configuration as recited in claim 6, wherein said pedestal means includes a plurality of spacer blocks defining a pedestal continuously extending between said first leg retaining member and said upper pedestal surface.

8. The base configuration as recited in claim 5, wherein said first and said second leg retaining members comprise disk-shaped members having said channels thereof radially extending outwardly from the central axes of said disk members.

9. The base configuration as recited in claim 8, wherein said channels formed within said first and said second leg retaining members are of cooperative depths such that when said first and said second leg retaining members are operatively secured together, they retainably engage said plurality of leg members along the full vertical heights of those portions of said one ends of the legs engaged thereby.

* * * * *

UNITED STATES PATENT AND TRADEMARK OFFICE
CERTIFICATE OF CORRECTION

PATENT NO. : 5,630,646

DATED : 5/20/97

INVENTOR(S) : Trimble

It is certified that error appears in the above-identified patent and that said Letters Patent is hereby corrected as shown below:

On the cover page, under "References Cited; U.S. PATENT DOCUMENTS, insert the following additional references --383,808 5/1888 Hall--

--3,385,550 6/1968 Doerner 248/417--

--4,536,029 8/1985 Rogers, Jr. 297/281--

--4,700,920 10/1987 Horn 248/370--

In Claim 2, Column 8, line 60, "Qf" should read --of--.

In Claim 2, Column 9, line 2, "Upper" should read --upper--.

Signed and Sealed this

Fourth Day of November, 1997

*Attest:*

*Attesting Officer*

BRUCE LEHMAN

*Commissioner of Patents and Trademarks*